US006390584B1

(12) United States Patent
Larson et al.

(10) Patent No.: US 6,390,584 B1
(45) Date of Patent: May 21, 2002

(54) LABEL PRINTING SYSTEM AND METHOD

(75) Inventors: Gregory Paul Larson, Moorpark; David Bryant, Solvang, both of CA (US)

(73) Assignee: AMT Datasouth Corp., Camarillo, CA (US)

( * ) Notice: Subject to any disclaimer, the term of this patent is extended or adjusted under 35 U.S.C. 154(b) by 0 days.

(21) Appl. No.: 09/620,803

(22) Filed: Jul. 21, 2000

Related U.S. Application Data

(60) Provisional application No. 60/145,351, filed on Jul. 23, 1999.

(51) Int. Cl.[7] ..... B41J 29/38; B41J 2/01

(52) U.S. Cl. ..... 347/16; 347/105; 347/5

(58) Field of Search ..... 347/16, 104, 5, 347/19, 101, 105; 226/190

(56) References Cited

U.S. PATENT DOCUMENTS 5,183,219 A * 2/1993 Abeille et al. ..... 242/340
5,259,648 A * 11/1993 Gerber ..... 283/81
5,488,223 A * 1/1996 Austin et al. ..... 347/19
5,810,494 A * 9/1998 Menard et al. ..... 347/104
5,947,463 A * 9/1999 Honegger ..... 271/3.01
6,145,722 A * 11/2000 Behrens et al. ..... 225/42

* cited by examiner

*Primary Examiner*—John Barlow
*Assistant Examiner*—An H. Do
(74) *Attorney, Agent, or Firm*—Raymond A. Bogucki

(57) ABSTRACT

A system for aligning labels on label stock of different sizes with the print head in a printer is disclosed. The label stock is wound around a tubular core, which has a ring shaped groove in its inner surface at the midpoint of its length, forming a roll of label stock. The continuous liner strip contains synchronization holes and identification holes.

The system includes a printer having a spindle mounted on a pedestal and holding the roll of label stock to be fed into the printer. The spindle is undersized relative to the tubular core and includes a ring shaped protrusion at its midpoint for engaging the groove in the inner surface of the tubular core. This roll of label stock is automatically maintained centered on the midpoint of the spindle, by its own weight, as it turns around the spindle as the label stock advances.

The system also includes an optical detector movably mounted within the printer, for detecting synchronization holes and identification holes in the liner during print head traversal. The system includes a paper feed drive and a print head stepper mechanism. A controller within the printer receives signals from the optical detectors and converts the signals to commands to the paper feed drive and a print head mechanism to adjust for particular parameters.

4 Claims, 5 Drawing Sheets

LABEL PRINTING SYSTEM AND METHOD

REFERENCE TO PRIOR APPLICATION

This invention relies for priority on a previously filed provisional application entitled "LABEL POSITIONING AND ROLL CENTERING APPARATUS FOR LABEL PRINTER", filed Jul. 23, 1999, Ser. No. 60/145,351.

FIELD OF THE INVENTION

The invention relates to a system for printing labels packaged on a continuous roll of backing material, and for automatically aligning the roll of labels in relation to the printer and controlling the printer to adjust settings and data to assure proper printing on the labels.

BACKGROUND OF THE INVENTION

Adhesive labels are useful to attach text or graphics to articles that do not fit easily into a printer, do not have a surface that accepts ink well, or that may require changes or updating of labels. Blank labels are generally placed along a liner sheet or strip with their print surface facing away from the liner, being adhered to the liner by an adhesive that separably attaches them to the liner, which has a very low friction, non-adhesive surface. The label can be manually marked, or placed in a typewriter, but in commercial operations it is most commonly printed on by using a graphics printer; which can print, for example, images, bar codes, or text. Because of the characteristics of the liner and adhesive, the label is removable from the liner after printing, with the adhesive remaining with the label. The label then attaches securely by the adhesive with the print side displayed, to a material such as paper, cardboard, wood, plastic or metal.

An effective system for packaging blank labels affixes a number of labels, using a separable adhesive, to a continuous strip of low friction liner. This strip of label stock is wound around a tubular core to form a roll. Frequently, the label stock will be one label wide and many feet long, enabling sequential printing on many labels. Other configurations with two or more side by side, are also used. The width of the label stock is dependent on the size and disposition of the labels to be printed. The number of labels in a roll is generally limited to the capacity of the largest diameter roll a printing machine can accept. The roll typically is mounted in the printer on a spindle such that the label stock may be unrolled and fed through the printer as the labels are to be printed. The labels may be printed on demand, that is, one at a time; or a batch of labels may be printed in a continuous process.

Usually the spindle is positioned between upstanding legs of a pedestal, holding the roll of label stock in alignment with a paper insertion cavity in the printer. The roll is free to rotate around the spindle, so that the labels may be moved one at a time through the print mechanism by means of friction rollers driven by bi-directional electric motors. Inside the print mechanism is a print head which traverses the label along a scanning line transverse to the lengthwise direction of movement of the label stock. The print head may comprise any of a number of known printer mechanisms including an impact head acting on a ribbon, heating elements acting on thermal sensitive paper, and ink-jet array, or a laser or diode dry printer. The movements of the label stock and the print head are generally controlled by a microprocessor or other controller through driver motors which can provide relative positioning in two dimensions.

In order to properly use the label area, the printer must accurately align the label with the print head as to both the length and the width of the label. However, a printer usually must be able to prepare many different types of labels. Thus, the printer should be able to accept print label stock of different widths and materials, while maintaining alignment. The printer must have either a means to advance the roll of label stock in proper position or compensating mechanisms to properly feed the label stock into the print mechanism. An erratic off-center roll location leads to errors in placement or feeding and requires mechanisms or software to properly align or control the feeding of the labels into the printer. Such compensating mechanisms may be complicated and increase the effort required of the operator to load the roll of label stock into the printer.

In order to print properly on labels of different lengths and widths, the printer preferably has some means for identifying the geometry of the labels to the microprocessor controller. Traditionally this means has been an input keyboard through which an operator enters the information. Minor alignment corrections can be accomplished automatically by providing marks in the label stock, a sensor in the printer to detect the location of these marks, and a program within the controller to correct its commands to the driver motors.

Additionally, information about the type of labels in the roll must be entered into the microprocessor controller, for example, information as to the type of material from which the labels are made. This information may be used to determine the optimum temperature for heating elements within the printer, as for an ink-jet system. Traditionally this information also has been entered manually by an operator. Any information that must be entered manually increases the effort required of the operator and introduces an opportunity for human error.

The invention accordingly has an object of providing a system to accurately and conveniently align rolls of label stock of various widths with the print head in a label printer.

It is also an object of the invention to provide a system which automatically identifies the type and position of labels contained on a roll of label stock so that printing positions, geometries, and styles can be varied.

SUMMARY OF THE INVENTION

A system in accordance with the invention provides advantageous means for aligning labels relative to the print head in a printer in which a roll of label stock of any of a range of widths may be easily mounted on a printer spindle, while the roll is retained in a centered position through an interior mechanism. The system also ascertains the dimensions and location of the labels, by scanning the liner strip and indicia provided on the liner strip holding the labels. The system further provides an arrangement for automatically identifying to the printer particular parameters needed for printing, so that predetermined adjustments may automatically be made for best printing. The system reduces manual effort, decreases the chance for operator error, and provides error detection in the event of misplacement or coding errors.

The invention includes a system to center labels carried on a roll of label stock with respect to the print head of a printer even though the label stock is of some arbitrary width within an acceptable range. The labels are removably attached on a continuous liner strip wound about a tubular core that has a central or other discontinuity, such as a circumferential groove or protrusion. The printer spindle is of smaller outer diameter than the inner diameter of the core, and incorporates a central circumferential discontinuity, groove or ring, mating with a complementary discontinuity (ring or groove) on the inside of the core. The roll of label stock and labels is held by its own weight in the centralized position on the spindle as the label stock is unwound. The core is advantageously made as two tubular end elements joined by a central spacer of larger inner diameter defining a central groove, although the discontinuity may be at some other transverse position.

Further in accordance with the invention, indicia are included in the liner strip and an optical detector in the scanning head is disposed to detect those indicia and the strip width as the scanning head scans the strip. At least two types of indicia are used, one being a positional reference as to the label, and the being other encoding information needed to set control parameters in the printer if standard conditions are not to apply. The positional references, which may be holes in the liner, are placed in one margin in a predetermined location relative to each label end so that lengthwise label dimension can be determined. The code information is disposed in the other margin in positionally varied sets also referenced to the positioning holes, and may comprise a predetermined number of holes, lying at varying lengthwise positions in a number of predetermined locations. After scanning to derive the code information, the controller then retrieves commands from a look-up table in its memory for use in controlling the printing process. For example, with an ink-jet head the temperature of heating elements and the speed of printing may be controlled for best results. The distance from one label to the next is ascertained and compared to what it should be from the label description identity, and if it varies from the prescribed value or if the codes are not proper this information is used to stop the printer.

Methods in accordance with the invention incorporate a number of scanning steps to determine from the strip, and the indicia, data which verify at each label if desired that the labels are correct, the codes are properly sized and correct, and that certain printing conditions must be used. This information is converted into commands such that complex multicolor images can be placed on each label with assurance of reliable operation.

BRIEF DESCRIPTION OF THE DRAWINGS

A better understanding of the invention may be had by reference to the following description, taken in conjunction with the accompanying figures, in which.

DETAILED DESCRIPTION OF THE INVENTION

In the following description of a practical example of a system, reference is made to the accompanying drawings which form a part hereof It is to be understood that other variants may be utilized and structural changes may be made without departing from the scope of the present invention. For example, although the description and drawings reference a roll of label stock, it is understood that printers in accordance with the present invention may be used to print media in other forms such as a roll of ticket stock, a roll of tag stock, or perforated sheets on a roll.

Figure 1:
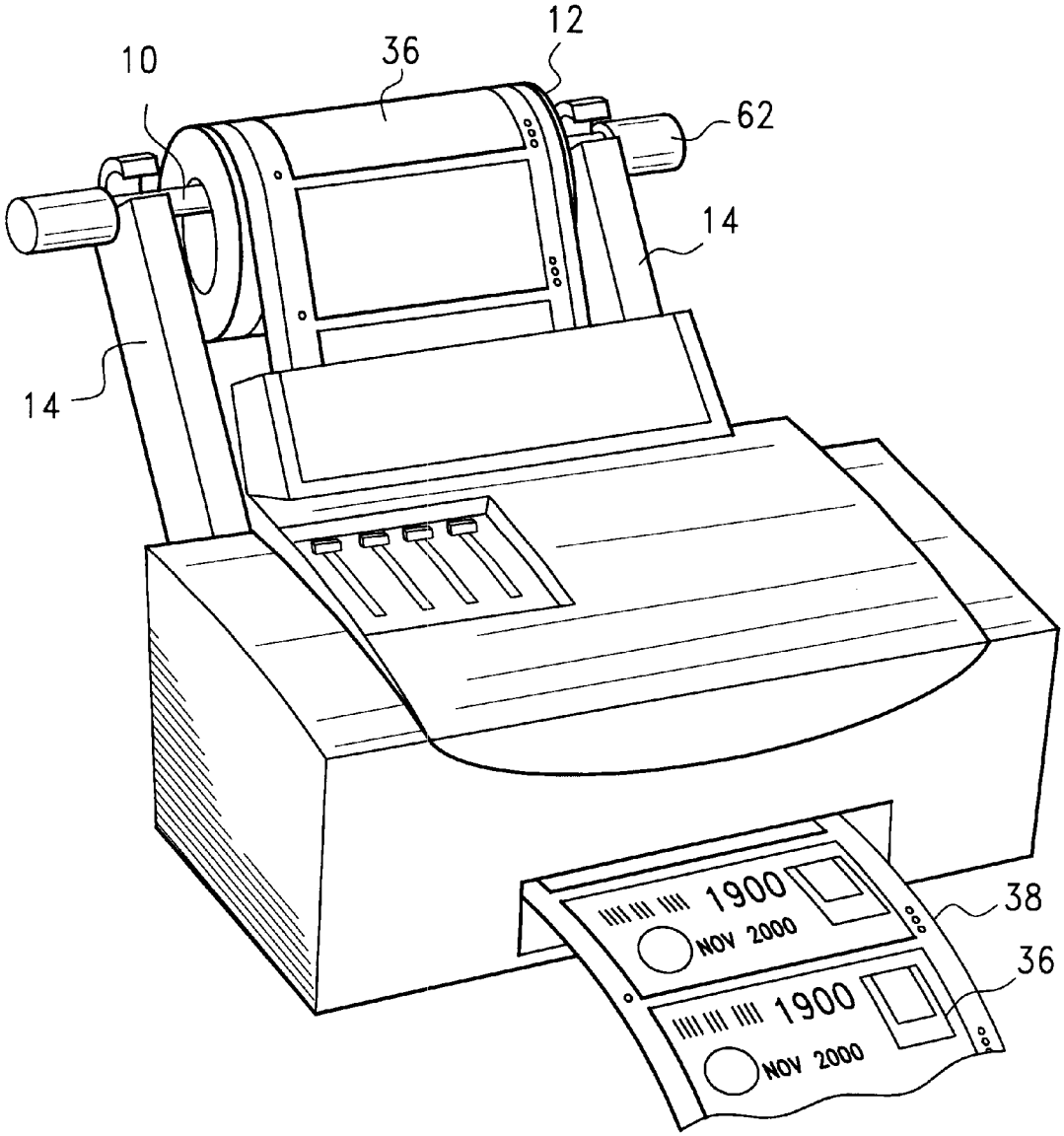
FIG. 1 is a perspective view, partly in phantom, of a printer system in accordance with the invention.
Figure 3:
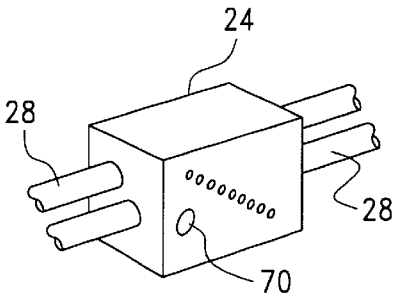
FIG. 3 is a fragmentary perspective view of an ink-jet print head with an optical detector as used in the system of FIGS. 1 and 2.
Figure 2:
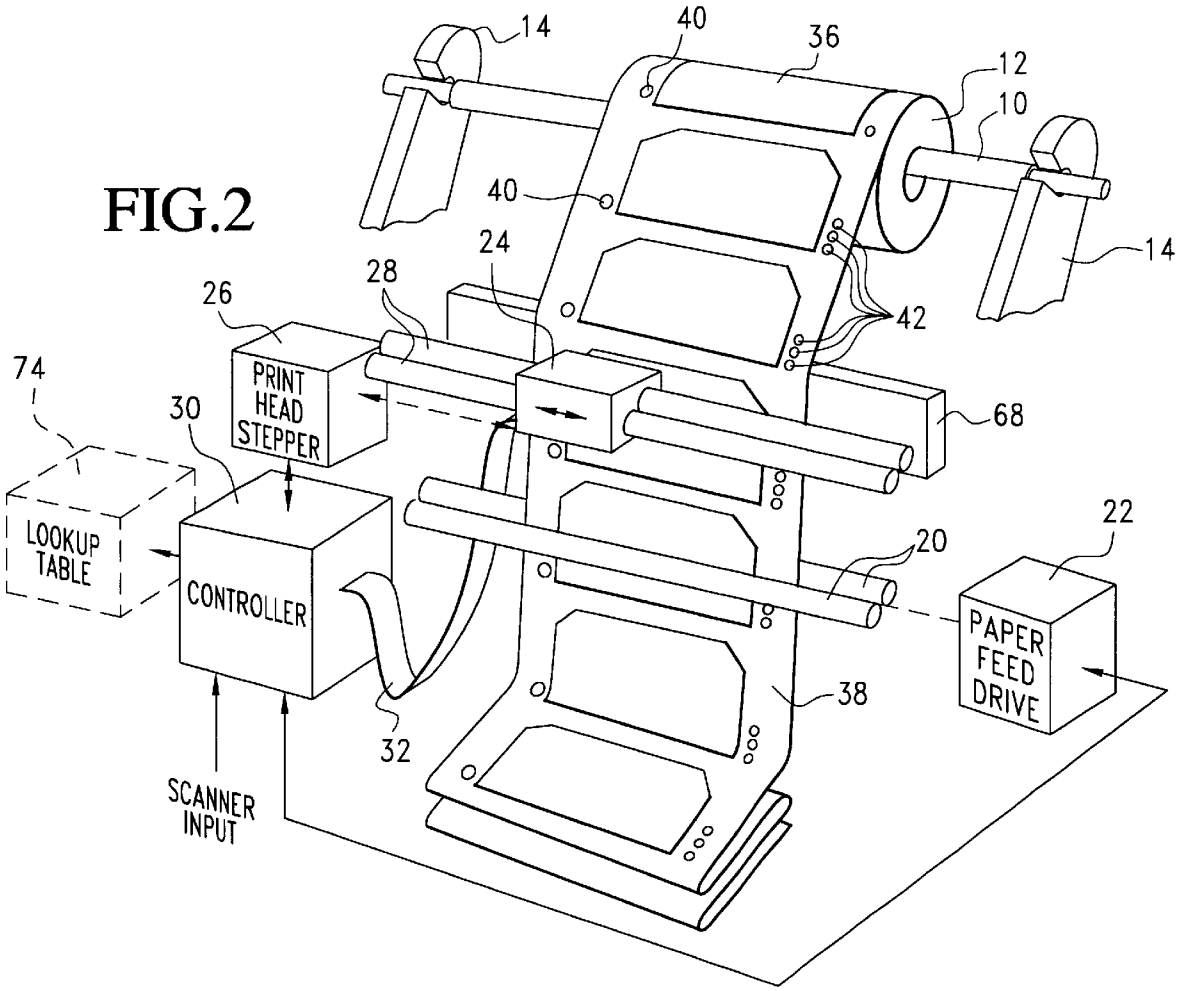
FIG. 2 is a simplified perspective view of the system of FIG. 1 doing the paper handling path in greater detail together with other elements in block diagram form.

The system to print labels, referring now to FIGS. 1–3, includes a roll of label stock 12, of a width suitable for the size and placement of labels on it, mounted on a supply spindle 10 traversely disposed between upstanding legs of a pedestal 14 and attached to a printer 13. The roll of label stock 12 has an oversized internal diameter relative to the outer spindle 10, which is mounted on the printer 13 between the two sides of the pedestal 14. The label stock 12 is unwound from the roll and fed through the printing mechanism 13, with the roll turning about the spindle 10 but laterally restrained. One or more friction roller pairs 20 (FIG. 2) driven by a paper feed drive 22 and moves the label stock 12 past one or more guide rail(s) 28 along which a scanner and print head 24 is moved by a stepper mechanism 26. The print head is transported transversely and bi-directionally across the width of the label stock by the stepper mechanism 26 at a scanning or printing rate. Movements of the label stock 12 and the scanner and print head 24, which can be in either direction, are determined by the printer's controller 30 which sends commands to the drivers 22 and 26 respectively. A flexible cable 32 between the print head and the controller 30 permits bi-directional travel by the print head across the full scan/print range. The label stock 12 comprises a number of labels 36 removably attached to a continuous low friction and low adhesion liner strip 38 at regular (usually closely spaced) intervals. The labels may vary from 2 to 10 inches wide in this example, but the range of label size is limited only by the length of the spindle 10 used and the lateral travel of the print head 24., However, in order to include indicia or other markings on the liner 38, the labels 36 are not coextensive with the width of the liner strip 38, so margins exist on each side.

Figure 7:
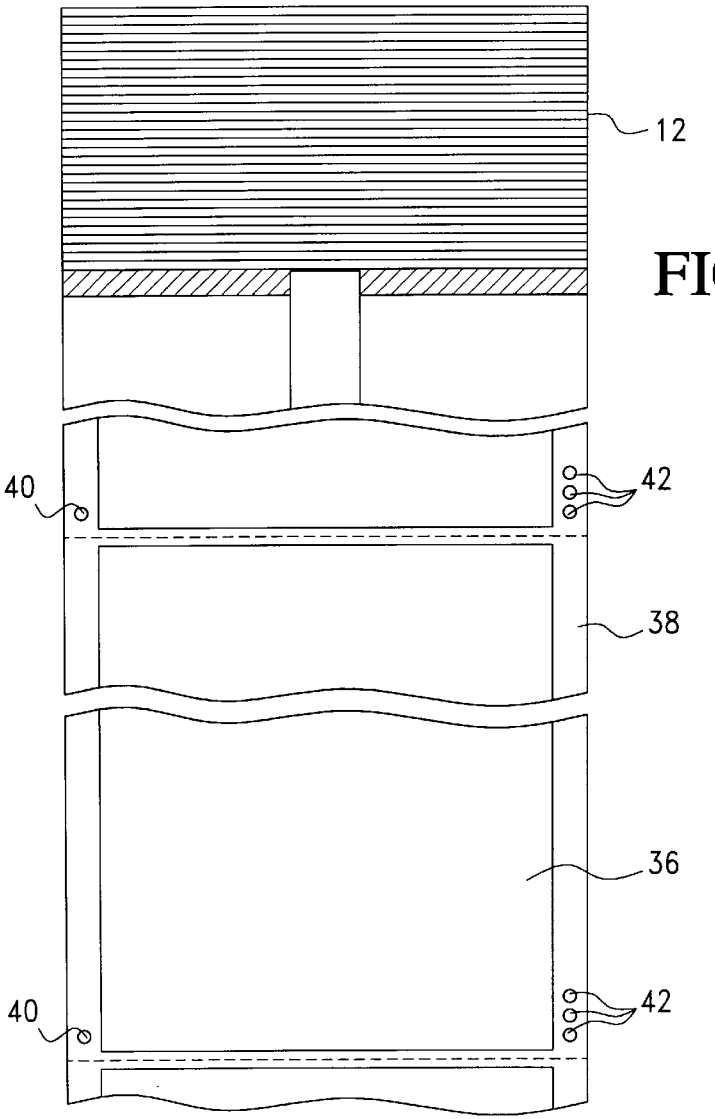
FIG. 7 is a plan view of a fragment of label stock having labels and indicia thereon.

Referring now particularly to FIGS. 2 and 7, one type of indicia, referred to as synchronization holes 40 are placed in the liner strip 38 at fixed locations along one margin relative to each label 36. The synchronization holes 40 are here at a fixed and known distance from the adjacent lengthwise edge of the closest label 36, along what may be called a "synchronization line" extending along the margin of the liner strip 38. The synchronization line is at a known distance from the liner strip 38, which can be optionally detected to start the procedure. Data or information holes 42 are also placed in the liner strip 38 at a number of chosen locations along the opposite margin of the strip 38. These locations are fixed lengthwise with respect to the synchronization holes 40 and transversely as well, so that once the synchronization holes has been located the label 36 position is known. Using a fixed number of three holes and eight potential locations, fifty-six different code patterns are available. Knowing that three information holes 42 are required to be on the opposite margin from the synchronization holes 40, errors and misplacements are readily detected. The synchronization holes 40 and information holes 42 may be referred to collectively as indicia, and it is recognized that printed markings, magnetic patterns and other detectable indicia may be used alternatively.

The peel off labels 36 are attached to the liner strip 38, with their print surface facing away from the liner. Because of low frictional, non-adhesive surface of the liner strip 38, the labels 36 may be removed from the liner strip 38 after printing, as the adhesive remains on the label, which may then be attached securely to a material such as paper, cardboard or wood with the print side displayed. Alternatively, lines between successive labels may be perforated (not shown) so that a customer may receive a container of labels for on site detachment.

Figure 4:
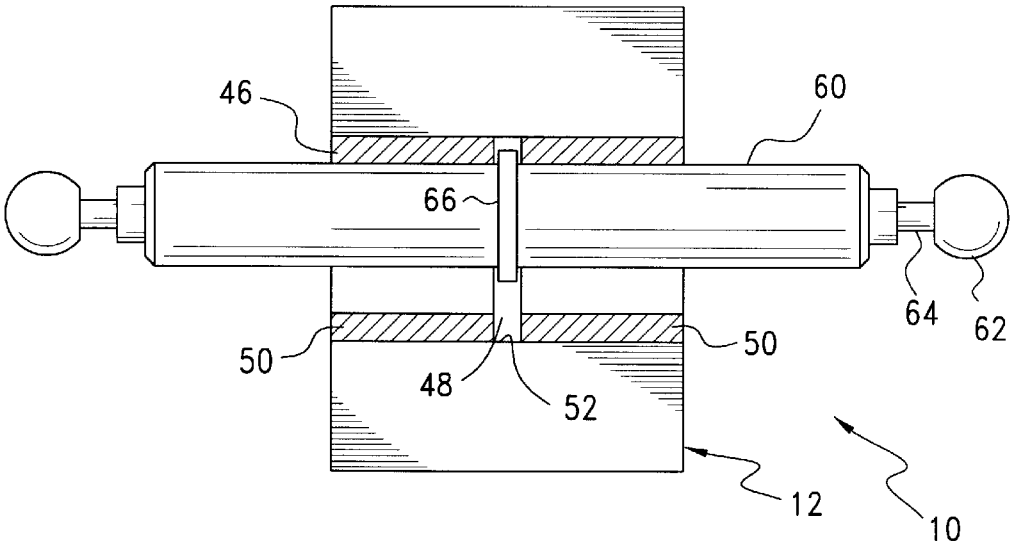
FIG. 4 is a side sectional view of a spindle and a roll of label stock configured to automatically center in accordance with the invention.
Figure 5:
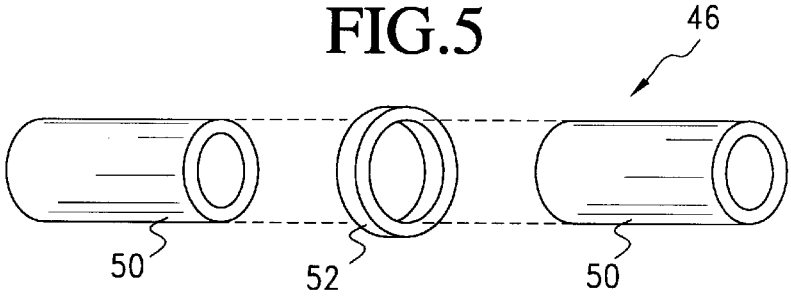
FIG. 5 is an exploded view of a core for a roll of label stock.
Figure 6:
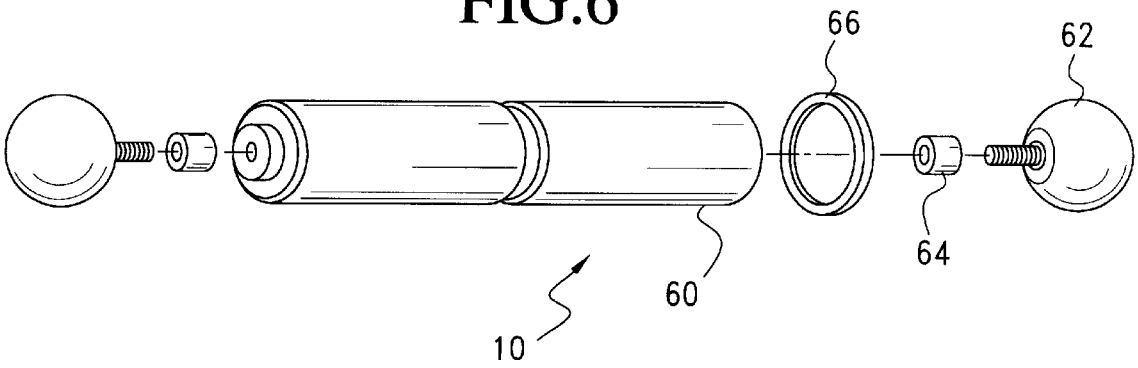
FIG. 6 is an exploded view of a spindle for use with a roll label stock of FIG. 5.

As best seen in FIGS. 4, 5 and 6, the roll of label stock 12 is composed of a tubular core 46 and a length of label liner strip 38 wound around the core. The tubular core 46 has a ring shaped circumferential groove 48 in its inner surface at the midpoint of its length. The tubular core 46 in this example is made from two equally sized tubular endpieces 50 of cardboard or plastic (FIG. 5) that are coupled together with a spacer ring 52 between them. The outside diameters of the two tubular pieces 50 and the spacer ring 52 are the same, but the wall thickness of the tubular pieces 50 is sufficiently larger than the spacer rings 52 thickness so that the smaller, inside diameter of the spacer then creates a round ring shaped cavity 48 (FIG. 4) inside the core 46 at its exact center. The label stock 12 is wound around this core 46 assembly and the roll is handled as a unit thereafter. The inside diameter of the core 46 is sufficiently larger than the spindle 10 so that the roll is free to rotate about the spindle with ease, but held on the spindle by its weight.

Alternatively, the core 46 may be constructed from one or more molded plastic parts, or even metal parts.

In this practical example, referring now to FIGS. 1, 4 and 6, the spindle 10 has a cylindrical center portion 60 along its principal length, an axle section 64 at each end of the center portion 60 for mounting on the pedestal 14, and a handle or knob 62 attached to each axle 64 on the end away from the center portion. Because the inner diameter of the core 46 is larger than the diameter of any part of the spindle 10, the spindle may be easily inserted through the opening in the roll and the roll 12 to be seated on the spindle 10. A fixed guide ring 66 larger in outer diameter than the spindle 10 is about the spindle 10 at the midpoint of the center portion 60. The width of the guide ring 66 is slightly less than the width of the cavity 46 in the core 40. When loading the roll of label stock 12 onto the spindle 10, the operator aligns it laterally so the guide ring 66 fits in mating relation into the groove 48 in the core 46. The weight of the roll 12 keeps it located on the guide ring 66 as it turns. The label stock 12 thus is free to unwind into the printer 13 and the roll 12 will track on the alignment formed by the spindle 10 and the supporting pedestals 14. While reversal of the feed direction is used, it does not exceed much more than the length of one label and the label stacks is not displaced or uncontrolled.

The spindle 10 is long enough to accommodate the width of a roll of label stock containing labels 36 up to the maximum width the printer can use. Rolls containing narrower labels 36 are correctly aligned with the center of the spindle 10 by the interaction of the guide ring 66 with the groove 48. Thus, the label stock 12 will enter the printer transport mechanism centered on the widest print line the printer 13 is capable of forming.

Figure 8:
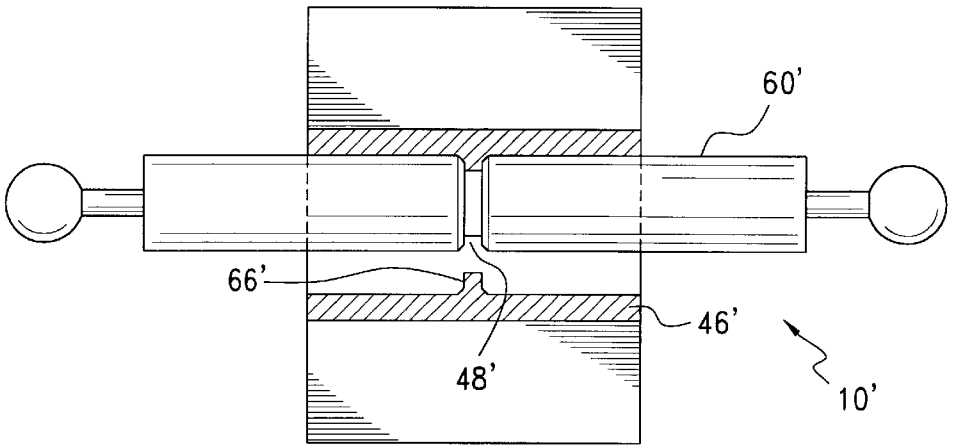
FIG. 8 is a of a second arrangement in accordance with the invention for automatically centering a roll of label stock.

Alternatively, the system may be implemented using a spindle 10' which has a ring shaped groove 48' at its midpoint along the length of its center portion 60', and a tubular core 46' that has a guide ring 66' at its midpoint, as shown in FIG. 8.

The printer transport mechanism (FIGS. 1–3) consists of a stepper mechanism such as a stepper motor and one or more friction rollers 20 for driving the label stock 12 between the print head 24 and a platen 68 in such fashion that the width of the roll is always centered to the middle of the widest possible print line. The controller 30 positions the label stock in the direction of its length by issuing commands to the paper feed drive 22. As the label stock 12 is moved along its length through the print mechanism 13, the roll supplies additional labels 36 as it rotates to allow the label stock to unroll.

The print head 24 includes an optical detector 70, as seen in FIG. 3. The controller positions the print head 24 in a direction transverse to the direction of travel of the label stock 12 by issuing commands to the stepper mechanism 26. The print head 24 imprints the labels 36 based on commands from the controller 30. The print head 24 may employ any one of a number of known printer mechanisms, including an impact head acting on a ribbon, a thermal head scanning thermal sensitive paper, an ink-jet head of any of several different types, or laser or diode systems acting on dry paper. The optical detector 70 is capable of sensing the condition in which no label stock 12 is present at the scanning position, thus locating the edge of the liner strip so that the synchronization line can be found and synchronizing holes located.

The indicia holes 40 and 42 are sized to meet the optical detector's field of view and sensitivity; thus, the detectors accurately detects position, as by sensing an edge of a hole.

The information or identification holes 42 are located a known lateral distance from synchronization holes 40, so that the controller can 30 command the print head 24 and optical detector 70 to be in line with the identification holes 42 and then to scan lengthwise along the identification holes 42. The controller 30 recognizes a binary combination defined by the presence of absence of hole detected at different positions (referenced to the lengthwise position of the synchronization holes 40). The controller 30 uses these codes to obtain information about the labels 36 from a look-up table 74 in its memory. Each table entry corresponds to a unique type of label and commands particular print instructions in accordance with the label's dimensions, the material from which it is made and other parameters that require adjustment, if any. The printer 13 derives control commands from controller 30 to address and optimally print information onto the label 36 in its proper location. The controller 30 also contains programs to compare the print program to the dimensions of the labels and send an error message if they are not compatible.

On start up, the controller 30 positions the optical detector 70 over the imaginary line on which the synchronization holes 40 lie after first locating the adjacent edge of the liner strip 38. The label stock 12 is then advanced until the first synchronization hole 40 is encountered, thus enabling determination of the edge of the adjacent label 36. The controller 30 then commands a sequence of steps to detect the code provided by the three information holes 42. If the information to be printed is not compatible with the stored look-up information, the printer 13 provides the operator with an error message, thus possibly avoiding the misprinting of labels due to improper label stock loaded in the printer or improper printing instructions for that label stock. Then the controller advances or retracts the label stock 12 to position the first label 36 under the print head 24 and to begin printing. For continuous label printing, once the first set of indicia holes have been detected, the controller may detect only the synchronization hole 40 for subsequent labels 36. Detecting subsequent synchronization holes 40 provides jam detection and allows minor positioning adjustments to be made if needed as the label stock is fed through the printer.

In demand mode, after a label 36 is printed, the label stock 12 is advanced until the printed label is available to the operator to be torn or cut-off. On the resumption of printing, the label stock 12 is retracted until the first available blank label 36 is positioned under the print head 24, thus avoiding wasted labels.

For a roll of labels mounted on a liner material, a roll of ticket or tag stock can be substituted. Again the ticket or tag stock contain indicia described herein and provide the printer with the same synchronizing, and identification controls as that described for the label rolls. Also, the edge sensing ability of the printer can be used in combination with a synchronizing hole to provide control indicia.

Figure 9:
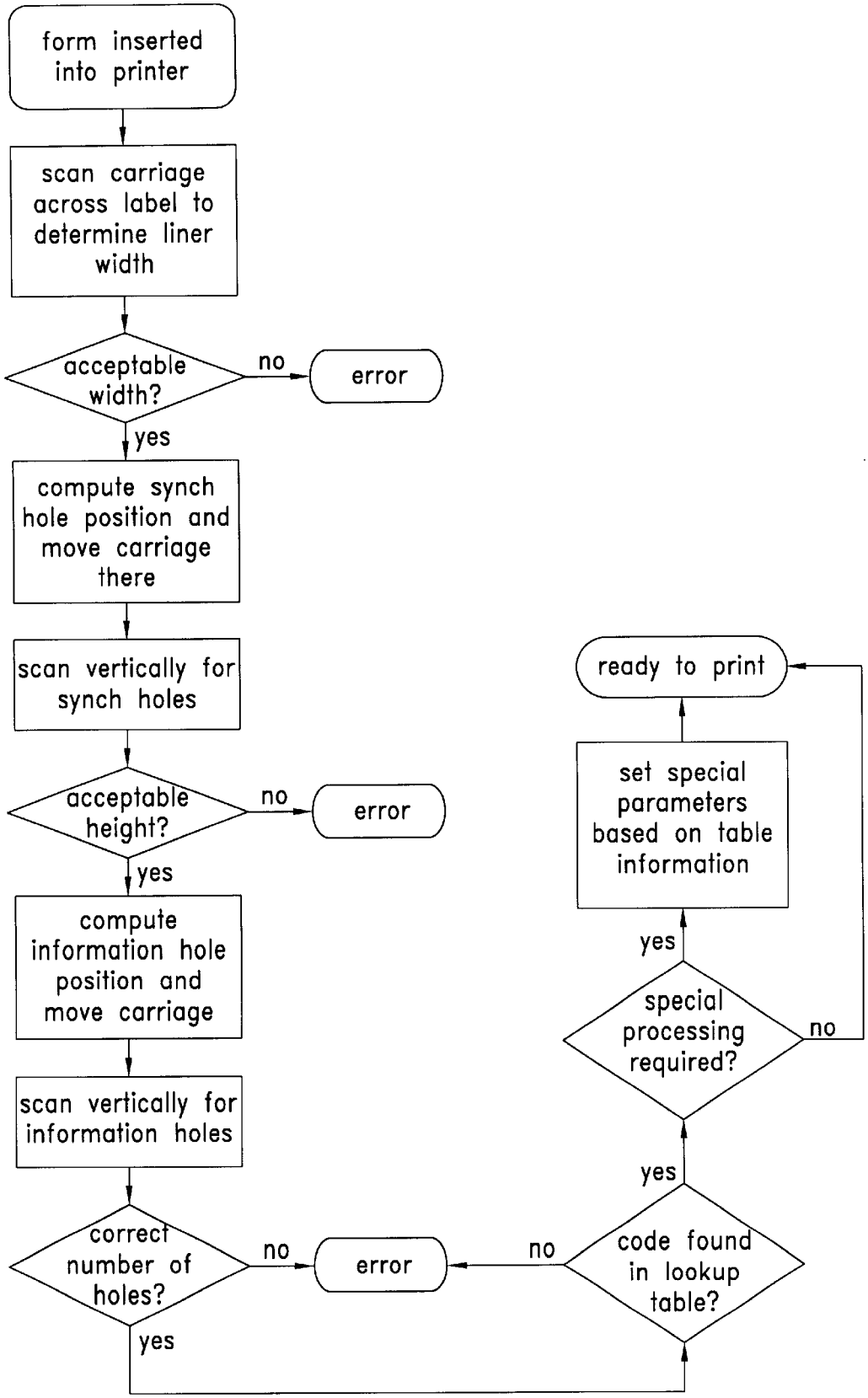
FIG. 9 is a block diagram showing a number of steps used in practicing methods in accordance with the invention.

An example of a label scanning and verification procedure employing the system of FIGS. 1–7 is shown in FIG. 9. The system controller, which operates the scanning head and receives detected signals indicating transitions, such as edges and holes in the liner, operates the feed to run the paper lengthwise, in either direction, and the scanning head transversely, in either direction. Thus the operation commences by scanning the carriage across the label, to locate the edge of the liner and to provide an indication if the liner is not of acceptable width.

Knowing that the liner of acceptable width, the scanning head is moved to a transverse position along one edge of the liner, outside the area of the label, in which line the synchronizing hole is positioned, in a fixed predetermined lengthwise relation to the transverse reference called the synchronizing line. By feeding the liner lengthwise, the synchronizing hole is located, and thereby the longitudinal edge of the label is determined Thus the lateral height can be calculated and determined to be acceptable. If not, the error condition can be indicated to prevent erroneous printing.

Since the information hole positions, although on the opposite margin of the strip, are at a known transverse spacing from the synchronizing hole, the scanner can be moved by the controller to be in-line with the column of information holes. The system then advances the liner strip to enable the position of the information holes to be detected, in relation to the lengthwise position of the synchronizing hole, while seeking the three indicia. By always using three information holes, at different ones of eight different positions, the most likely errors can be obviated or detected, such as a failure to have an adequate number of punched holes. The invariant number of three holes, distributed through eight different locations, then represents a code combination which is compared to the information stored in the look-up table, which identifies controls needed for special processing conditions, such as control of the heaters for an ink-jet printer, or print rate. When special parameters are to be set, the printing operation commences after the look-up step. Otherwise normal print settings are used.

The foregoing description of practical examples of the invention has been presented for the purposes of illustration and description. It is not intended to be exhaustive or to limit the invention to the precise form disclosed.

We claim:

1. A label stock including a media for supporting a series of lengthwise aligned detachable labels on which patterns are to be printed, comprising:

a label strip having a low friction surface for receiving detachable labels, the label strip having at least one marginal area apart from the labels;

optically detectable synchronizing indicia comprising holes in the media disposed in the marginal area adjacent each label position to provide a lengthwise reference indicia to identify the location of one lengthwise edge of a label along the strip; and optically detectable information indicia disposed in the marginal area characterizing the parameters needed for printing, the information indicia comprising holes in the media and being disposed lengthwise along the aligned labels and arranged in a binary combination set for each label, wherein each set has three positions in which individual holes are disposed in relation to one of eight potential locations, the sets being positioned at given optical lengthwise positions, such that the combination of indicia in the set and their lengthwise positions provide parameter characterizing information for printing.

2. A label stock media as set forth in claim 1 above, wherein the marginal areas are along the opposite margins of the media adjacent the labels, and wherein the synchronizing holes are disposed along a margin and selected lengthwise position relative to the edge of a different label.

3. A label printer system for printing on different successive detachable labels disposed along a support media, wherein the support media are variable in width and the detachable labels are variable in length and width within the size of the media, and comprising:

a roll support spindle of given outer diameter on the printer;

a roll of support media having an inner core of larger diameter than the spindle, the media having a width within a given range and receiving a series of detachable labels of arbitrary size and shape, the spindle and roll including mating discontinuities for automatically centering the roll while allowing withdrawal of media from the roll;

feed means including media drive mean's positioned along a chosen media path and including a print scan line;

scanning means including ink-jet print; head means movable along the print scan line and further including detector means to determine optically identifiable transitions on the media;

the media including synchronizing indicia comprising holes each separately disposed in given lengthwise relation to the edge of a different successive label on one side of the media;

the media further including a number of control indicia comprising a sequence of three holes disposed at different ones of eight separate locations along the opposite margin of the media and in relation to the edge of the labels, at different predetermined lengthwise locations separate from the synchronizing indicia for a label and detectable by the detector means, the control indicia identifying desirable printing parameters; and the controller means for operating the feed means and scanning means to determine the positions of the edges of the labels and the printing parameters, the controller means including stored information responsive to the printing parameters to effect printing in response to the date therein, and means for controlling the movement of the media lengthwise relative to the scanning head, and for controlling the transverse position of the scanning head along the print scan line, such that the detectors locate lengthwise and transverse positions of the holes.

4. A mechanism for readily positioning a roll print media transversely on a feed spindle of a given diameter, regardless of the width of the media, comprising:

a hollow axial core supporting the roll of media, the core including an inner discontinuity in the form of a circumferential recess at a selected transverse position relative to the roll, the inner diameter of the core being greater than the diameter of the spindle; and a circumferential discontinuity on the spindle at a selected transverse location and configured to mate with the discontinuity of .the core in the form of a circumferential protrusion relative to the major surface of the spindle, such that the media can be fed from the roll without transfer shifting of the roll after the discontinuities are engaged, the core interior being sufficiently larger than the spindle to permit ready mounting and dismounting of the roll on the spindle, and the core comprising end cylinders and a center spacer ring joining the end cylinders, the spacer ring being centered relative to the core and having an inner diameter relative to the inner diameter of the end cylinder as so to define the circumferential recess, and wherein the circumferential protrusion comprises an annular member of greater diameter than the spindle.

* * * * *